US005740973A

United States Patent [19]

Pöppinghaus

[11] Patent Number: 5,740,973

[45] Date of Patent: Apr. 21, 1998

[54] METHOD AND APPARATUS FOR CROSS-WINDING A WINDING MATERIAL ON A BOBBIN

[75] Inventor: Winfried Pöppinghaus, Bad Sooden-Allendorf, Germany

[73] Assignee: Georg Sahm GmbH & Co. KG, Eschwege, Germany

[21] Appl. No.: 675,794

[22] Filed: Jul. 5, 1996

[30] Foreign Application Priority Data

Jul. 6, 1995 [DE] Germany ..... 195 24 663.2

[51] Int. Cl.[6] ..... B65H 59/00; B65H 54/28

[52] U.S. Cl. ..... 242/43.2; 242/43 A

[58] Field of Search ..... 242/43 R, 43 A, 242/43.2, 158 R

[56] References Cited

U.S. PATENT DOCUMENTS

| | | | |
|---|---|---|---|
| 1,990,620 | 2/1935 | Schweiter | 242/43.2 |
| 2,145,935 | 2/1939 | Kinsella | 242/43 |
| 2,184,723 | 12/1939 | Parks | 242/43.2 |
| 2,350,928 | 6/1944 | Reiners et al. | 242/43 X |
| 2,753,126 | 7/1956 | Marcellus | 242/43.2 |
| 3,346,204 | 10/1967 | Hagihara et al. | 242/43.2 |
| 3,414,205 | 12/1968 | Aschwanden | 242/43.2 X |
| 3,690,575 | 9/1972 | Ito et al. | 242/43.2 X |
| 4,585,181 | 4/1986 | Schippers et al. | 242/43 A |

FOREIGN PATENT DOCUMENTS

| | | | |
|---|---|---|---|
| 561471 | 5/1957 | Belgium | 242/43.2 |
| 798801 | 5/1936 | France | 242/43 |
| 614 013 | 1/1934 | Germany . | |
| 1 816 271 | 7/1970 | Germany . | |
| 1 560 561 | 10/1970 | Germany . | |
| 20 05 621 | 8/1971 | Germany . | |
| 26 28 501 | 1/1978 | Germany . | |
| 33 41 928 | 6/1984 | Germany . | |
| 33 24 529 | 12/1985 | Germany . | |
| 36 28 735 | 2/1988 | Germany . | |
| 39 01 278 | 5/1990 | Germany . | |
| 42 37 860 | 5/1994 | Germany . | |
| 559927 | 3/1944 | United Kingdom | 242/43.2 |

OTHER PUBLICATIONS

Vorbereitungsmaschinen fur die Weberei, Ein Handbuch fur Spinner, Weber und Wirker, Von Dipl.-Ing. J. Schneider, Springer-Berlag, Berlin/Gottingen/Heidelberg 1963, pp. 20–27.

*Primary Examiner*—Michael Mansen

*Attorney, Agent, or Firm*—Thomas, Kayden, Horstemeyer & Risley

[57] ABSTRACT

A method for cross-winding of thread-like or band-like winding material on winders is described for the production of bobbins wound up in cross-winding with random winding or precision cross winding. The winding material is traversed by a slit drum (1) comprising a slit (5) and is wound up to a bobbin (18). The winding material is traversed by a slit drum (1) comprising at least three parts (2, 3, 2) forming the slit (5) and at least one crossing point (6). The winding material entering the slit drum (1) is guided by an auxiliary apparatus (10), which forces an additional motion to the winding material while passing each crossing point (6) of the slit (5) of the slit drum (1) to maintain the corresponding traversing direction (8).

15 Claims, 3 Drawing Sheets

METHOD AND APPARATUS FOR CROSS-WINDING A WINDING MATERIAL ON A BOBBIN

FIELD OF INVENTION

The invention related to a method for cross-winding of thread-like or band-like winding material on winders for the production of bobbins wound up in cross-winding with random winding or precision cross winding, whereby the winding material is traversed by a slit drum comprising a slit and is wound up to a bobbin. A device for implementing the method is described also.

DEFINITIONS

"Winding material" means all material in form of a thread, a band or the like, which can be wound up by cross-winding, including flat small bands having different width, wires, and yarns of fine mono- and multifilaments, as used in the textile and similar industry. "Traversing" means a motion of the winding material transverse to the wind up direction and back and forth, so that the portion of the winding material being just wound up on the circumference of the bobbin has a predetermined distance to the portion of the winding material being wound up before in the direction parallel to the axis of the bobbin. "Grooved drum" means a drum comprising grooves having defined deepness, i.e. the groove having a bottom. Such a grooved drum serves for traversing the winding material and consists often of a piece of material having a billed cross section (plastics) but also of a piece of a tube having a sufficiently large wall thickness, or in rare cases of sheet steel, which has been shaped by deep-drawing. "Slit drum" means a mostly hollow drum, being divided into two parts by the slit. A slit drum has no bottom of the groove and can be formed preferably of sheet steel or of a piece of a tube having small wall thickness. But also slit drums without shafts are known made of a piece of material having a filled cross section, the two parts of which facing each other. Often the term "grooved drum or roll" is used also for slit drums, making it impossible to distinguish between these two terms, which is most important for this invention. A groove belongs to a grooved drum and a slit belongs to a slit drum, both serving for traversing purpose. A "contact roller" is a roll being positioned between a grooved drum or a slit drum and a winding device.

BACKGROUND OF THE INVENTION

A method and a device of the type mentioned above, i.e. using a slit drum, is known from the book "Vorbereitungs-maschinen für die Weberei, ein Handbuch für Spinner, Weber und Wirker", Dipl. Ing. J. Schneider, Springer-Verlag, Berlin/Göttingen/Heidelberg, 1963, pages 20 to 27, especially pages 20 to 24. The shown slit drum comprises two parts made of a tube being cut at an angle, the edges of the two parts facing each other forming a looped and closed slit for the winding material. The slit has a screw-like shape and the winding material does not contact a bottom of a groove but extends through the slit from an entering point into the Slit drum to an outgoing point of the slit drum. The slit is a closed loop having no crossing point. The winding material is guided by the slit via the small edges of the two parts of the slit drum alternatively corresponding to the traversing direction. The friction speed on the edge of the slit depends on the difference between the circumferential speed of the slit drum and the speed of the winding material. Having a common direction the friction speed always is lower than the speed of the winding material. The traversing effect of the winding material is performed only by the slit drum or the slit between the two parts of the slit drum respectively. Since the two parts of the slit drum are driven in rotation only, the oscillating masses are advantageously very low. Only the portion of the winding material between a fixed feeding point and the touching point of the winding material on the circumference of the bobbin is the oscillating mass. The reliability of the guidance of the winding material is guaranteed as well during the linear transversing as also in the reversing points by the closed loop slit without a crossing point. Advantageously a swinging motion of the winding material perpendicular to the traversing direction is avoided. The rapidity of the reversing motion of the winding material on the ends of the bobbin may be varied by the shape of the slit of the slit drum. If the slit drum is driven forward in the direction between the entering point and the outgoing point of the winding material, then the friction speed between the winding material and the edges of the slit drum is lower than the speed of the winding material. The length of the portion of the winding material between the outgoing point on the slit drum and the circumference of a contact roller or of the bobbin in an winding device is very short. Using this slit drum wear appears only on those parts of the edges of the slit, which come into contact with the winding material. Advantageously such slit drums may be manufactured at low costs using normal machine tools. It is not necessary for such slit drums to be equipped with a gear. The main disadvantage of such slit drums is the diameter of the slit drum. A large traversing width requires a correspondingly large diameter of the slit drum. But the available needed room for the slit drum is often limited. With respect to this the pitch of the slit may be increased only to a certain limit. If the pitch is designed too large, the slit conveys the winding material out of the slit throwing the thread out of the slit drum to the circumference of the slit drum, so that any traversing motion is lost. This maximum limit of the pitch must not be exceeded to guarantee the desired traversing motion depending on the application, traversing width, and kind of the winding material.

Traversing devices of a different type, i.e. in form of a grooved drum according to the definitions mentioned above, are known from DE 42 37 860 A1 or from DE 36 28 735 A1. Using such a grooved drum the winding material is guided preferably on the bottom of the groove. Here the winding material surrounds the bottom of the groove in a certain angle. Depending on the traversing width the groove of the grooved drum has one or more crossing points. The design of the groove and especially at the crossing points is very complicated and uses different deepnesses of the parts of the bottom of the groove to avoid the conveying and throwing out effect of the winding material out of the groove and to secure the run of the winding material into the oncoming part of the groove at the crossing points. Caused by the surrounding of the bottom of the groove of the grooved drum by the winding material a certain friction (thread friction) acts between the winding material and the bottom of the groove, the amount of which depends mainly on the difference between the (constant) speed of the winding material and the (non-constant) circumferential speed of the bottom of the groove. Winding bobbins in random cross-winding the outer circumference or the grooved drum often is used as a contact drive of the circumference of the bobbin. This avoids a separate contact roller. Here the winding ratio depends on the geometry of the groove and cannot be designed separately. Here also the mentioned friction (thread friction) occurs, because the circumferential speed at The outer diameter of the grooved drum is nearly equal to the speed of the winding material, and thus the circumferential speed at the bottom of the groove is necessarily lower than the speed of the winding material.

Using grooved drums has the following advantages

The oscillating masses are low, because only the winding material oscillates. The reliability of the guidance of the winding material is guaranteed as well during the linear transversing as also in the reversing points by the closed loop groove provided the complicated design of the groove. The rapidity of the reversing motion of the winding material on the ends of the bobbin may be varied by the shape of the groove of the grooved drum. The friction speed between the winding material the areas of the grooved drum, especially at the bottom of the groove, is lower than the speed of the winding material. Wear occurs at the contacting areas of the groove to the winding material, especially at the bottom of the groove. The outer diameter of the grooved drum does not depend on the traversing width. A gear is not needed with grooved drums.

Using grooved drums has the following weighty disadvantages:

A swinging motion perpendicular to the traversing direction of a portion of the winding material is caused by the different deepnesses of the portions of the groove. The length of the portion of the winding material between the bottom of the groove and the circumference of a contact roller or of the bobbin in an winding device is very great. The reliability of the grooved drum depends on the complicated shape of the groove, especially at the crossing points. High manufactural costs can only be avoided by using moulds in the production line of the grooved drums. The manufactural costs depend on the number of pieces and thus are high with a low number of grooved drums.

To counteract these disadvantages grooved drums having a nearly constant and low deepness of its groove are described in DE 18 16 271 A1 or in DE 39 01 278 A1 or in DE 33 41 928 A1. A traversing device is allocated upstream to these grooved drums. This traversing device causes the essential traversing motion to the winding material and guides the winding material over the crossing points of the groove of the grooved drum. The advantage of the grooved drum is used to create a rapid reversion movement in the area of the ends of the bobbin. But the oscillating masses are increased by the mass of the traversing device. This is a disadvantage as far as wear and limitation or the speed of the winding material is concerned.

Traversing devices are known from DE 26 28 501 A1 or from DE 20 05 621 A1, the essential elements of which consist of a scroll cam and a yarn guide. The invention is not directed to those devices.

PURPOSE OF THE INVENTION

It is an object of this invention to provide a method and a device of the type mentioned above, which make the traversing motion of the winding material possible by the use of a slit drum having no parts driven back and forth except the winding material so that the oscillating masses are as low as possible. Even for great traversing width an increase of the cross section of the traversing device should be avoided.

SUMMARY OF THE INVENTION

According to the invention, this object is realized with a method, in which the winding material is traversed by a slit drum comprising at least three parts forming the slit and at least one crossing point, and the winding material entering the slit drum is guided by an auxiliary apparatus, which forces an additional motion to the winding material while passing each crossing point of the slit of the slit drum to maintain the corresponding traversing direction.

The invention is based on the idea to divide the known slit drum consisting of two parts now into at least three parts, thus, the looped slit is formed by these three or more parts. A slit drum consisting of three parts has one crossing point in its slit. A slit drum consisting of four parts has two crossing points in its slit etc. This gives the possibility to enlarge the traversing width without the necessity to exceed the pitch limit. So, even with a high traversing width small diameters of the slit drum may be designed. The traversing motion of the winding material is performed only by the slit drum, which has only parts driven in rotation, thus not increasing the oscillating masses. Since the slit drum has no bottom of a groove and the wall thickness of the slit drum is comparatively small, there are difficulties for the winding material while passing crossing points or the slit. The winding material is guided by an auxiliary apparatus, which acts only in the region of the crossing point and forces an additional motion to the winding material while passing each crossing point of the slit of the slit drum to maintain the corresponding traversing direction to guarantee the pass of the crossing points safe, reproducible and analogous in the two traversing directions. The action of the auxiliary apparatus is not connected directly to the traversing movement. The traversing movement only is a result of slit drum. The auxiliary apparatus is only active in one or more small portions across the traversing width. For this reason it is tolerable to use an auxiliary apparatus having an oscillating mass. The stroke of this mass is only a small part of the traversing width. In addition, there is the possibility to drive the auxiliary apparatus with a lower number of revolutions compared with the number of revolutions of the slit drum by increasing the number of the traversing elements of the auxiliary apparatus.

Of course in is better to drive all of the parts of the auxiliary apparatus only in rotation so that it is only the portion of the winding material between a fixed feeding point and the touching point on the circumference of the bobbin which is the oscillating mass.

The auxiliary apparatus is driven in rotation in a manner so that the number of revolutions of the auxiliary apparatus is a whole numbered even part of the number of revolutions of the slit drum. Thus, the number of revolutions of the auxiliary apparatus is ½, ¼, ⅙, ⅛ etc. of the number of revolutions of the slit drum. It is obvious that high working speeds may be performed by using this new method and high production speeds of the winding material may be applied.

The new method has the further advantage of acting safe and troublefree. Swinging motions perpendicular to the traversing direction do not occur. The reliability of the guidance of the winding material is guaranteed as well during the linear transversing as also in the reversing points by the closed loop slit. Since the shape of the reversing points of the slit may be designed without limitation, even rapid reversing points may be used to increase the stability of the bobbin. The friction speed between the winding material and the slit of the slit drum is lower than the oncoming speed of the winding material. The length of the portion of the winding material between the slit and the circumference of a contact roller or of the bobbin in a winding device is very short. Wear occurs only on those parts of the slit coming into contact with the winding material. The parts of the slit drum can be manufactured very easily using ordinary machine tools. The both end pieces of the slit drum are alike or nearly alike. The middle pieces between the end pieces may also be alike or nearly alike. The diameter of the slit drum depends on the traversing width only to a very small degree. The slit may have a great pitch and thus generate a great traversing width even on a slit drum having a small diameter.

The device of the type mentioned above for implementing the method uses a driven slit drum, which comprises at least three parts forming the slit having at least one crossing point. An auxiliary apparatus is provided to force the winding material while passing the crossing point with an additional motion directed in traversing direction. The auxiliary apparatus comprises at least two traversing elements per crossing point. The auxiliary apparatus is driven by a drive having a number of revolutions, which corresponds to the number of revolutions of the slit drum divided by the total number of the traversing elements per crossing point.

The new slit drum, compared with the known slit drums, is broadened in traversing direction so that the dependence between the traversing width and the diameter of the slit drum is no longer existing. The so formed closed loop slit of a slit drum consisting of three parts extends over two revolutions of the circumference of the slit drum generating one crossing point. A slit drum consisting of five parts has three crossing points etc. The auxiliary apparatus acts on the winding material during the pass of each crossing point. For each crossing point a separate auxiliary apparatus may be used. But it is possible and useful to have a common auxiliary apparatus for all the crossing points. Since each crossing point must be passed alternatively in the one and in the other traversing direction, it is useful to provide on the auxiliary apparatus two traversing elements for one crossing point, one traversing element for each traversing direction. In the simplest embodiment with two traversing elements the auxiliary apparatus is driven with half the number of revolutions compared with the number of revolutions of the shaft of the slit drum. If four traversing elements are allocated to one crossing point, the auxiliary apparatus is driven with a quarter of the number of revolutions.

The auxiliary apparatus may be designed so that to comprise only parts being driven in rotation. Since the number of revolutions is low high speeds of the oncoming winding material may be performed. Problems of wear do not exist.

The auxiliary apparatus may be located outside of the slit drum. The auxiliary apparatus is located upstream to the slit drum so that it acts on the winding material in the region of the entering point of the slit drum, but only for the passing movement of a crossing point. In the simplest embodiment the auxiliary apparatus comprises a shaft, on which two traversing elements in form of arms, bows or the like are positioned. The one traversing element is allocated to the one traversing direction and the other traversing element is allocated to the other traversing direction.

But it is possible also to locate the auxiliary apparatus inside of the slit drum. Thus, the auxiliary apparatus is not only protected by the slit drum but the whole unit requires only a little room. The traversing elements act in the interior of the slit drum and force the entering portion of the winding material.

The slit drum may comprise a shaft connecting the parts of the slit drum with each other for common rotation. This shaft is a simple way to position the three parts in relation to each other and to fix the three parts forming the closed loop slit and the crossing point at the same time. The shaft does not act on the winding material, i.e. normally there is no contact between the shaft and the winding material. In this embodiment a construction kit is possible. On a shaft having a sufficient length a number of the parts of the slit drum may be pushed and fixed. The number of the middle pieces may vary and the number of the end pieces always is two.

A reduction gear is provided between the slit drum and the auxiliary apparatus. The reduction gear is designed according to the number of the traversing elements. This reduction gear may be located outside or inside the slit drum. This reduction gear connects the drive of the slit drum and the drive of the auxiliary apparatus in a fixly defined manner. From this the advantage results that a newly started beginning of the winding material is traversed automatically in correct manner, independent from the point at which the thread first comes into contact with the slit.

In a special embodiment the auxiliary apparatus may comprise two shafts being driven in opposite direction, the shafts being provided with the traversing elements. The one shaft with its traversing elements is allocated to the one traversing direction and the other shaft with its traversing elements is allocated to the other traversing direction.

BRIEF DESCRIPTION OF THE DRAWINGS

The invention is further explained and described by preferred embodiments. The drawings illustrate.

DETAILED DESCRIPTION

Figure 1:
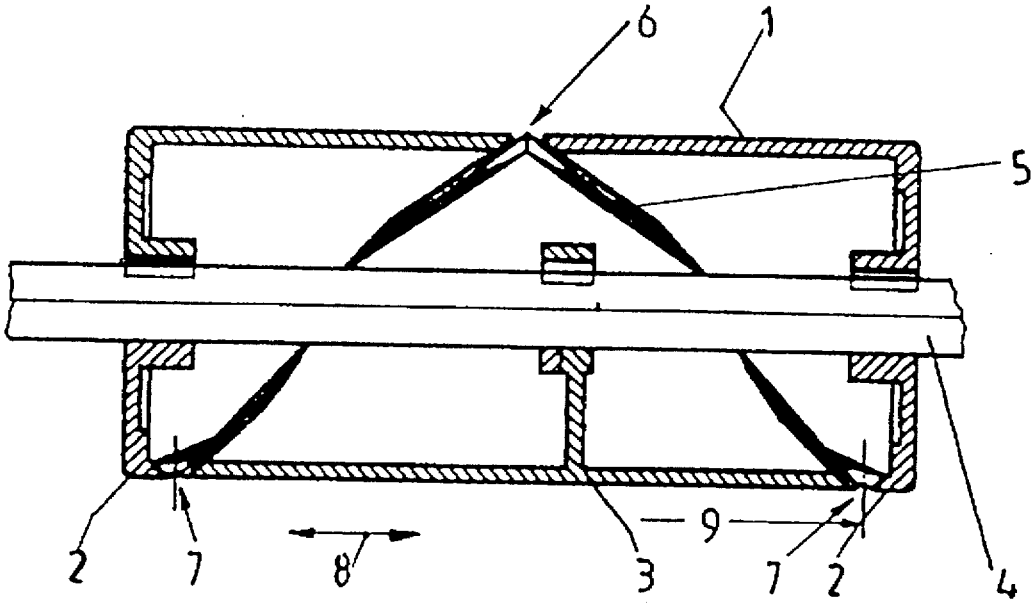
FIG. 1 a section view of the slit drum in the simplest embodiment.

FIG. 1 illustrates the essential elements of a winding drum in the form of a slit drum 1 in the simplest embodiment. The slit drum 1 comprises two separate end pieces 2 and a separate middle or central piece 3. The end pieces 2 are formed alike. The end pieces 2 and the middle piece 3 each have a thin outer wall and are fixed on a common drum shaft 4 and thus positioned with respect to each other as illustrated. The rims or edges of the walls between one end piece 2 and the middle piece 3 and the other end piece 2 facing each other form a continuous helical slit 5 extending in the shape of a lying eight screwlike over the circumference of the slit drum 1. The slit drum 1 or its parts 2 or 3 have a relatively small wall thickness. The slit 5 is open in radial direction, i.e. there is no bottom of the slit contrary to grooved drums containing a groove with a bottom. The slit 5 provides a crossing point 6 and two reversing points 7. The run on the slit 5 is crossing in the crossing point 6. The traversing direction 8, which is illustrated by a double headed arrow parallel to the axis of the shaft 4, changes in the reversing points 7. The traversing width 9 is determined by the distance between the two reversing points 7.

The embodiment of FIG. 1 illustrates the combination of two end pieces 2 and one middle piece 3 generating one crossing point 6. It goes without saying that to extend the traversing width 9 two end pieces 2 can be combined with two middle piece 3. In this case the middle pieces 3 are also alike, at least with respect to the run of its edges forming the slit 5. They are positioned on the shaft 4 twisted by 180° to each other. Using two middle pieces 3 generates two crossing points 6. This system may be expanded. The number of the crossing points 6 always is equal to the number of the middle pieces 3. Thus, a slit drum consisting of three parts has one crossing point, a slit drum consisting of four parts has two crossing points etc.

Figure 2:
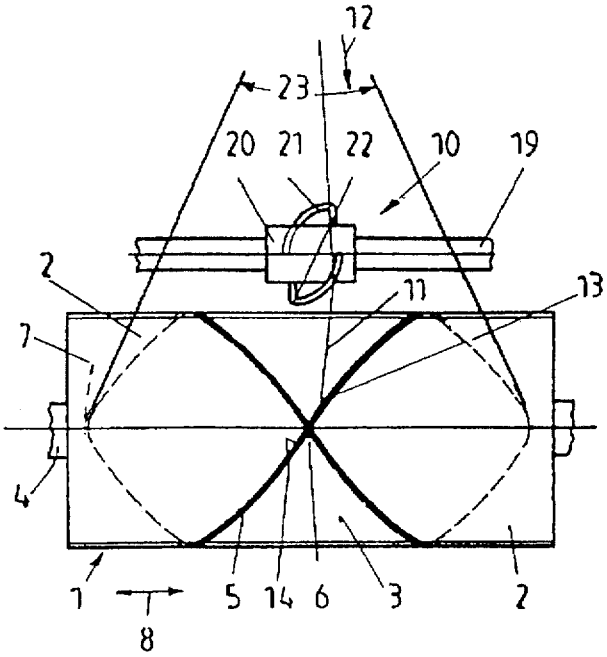
FIG. 2 a schematic view of the device comprising the slit drum and an auxiliary apparatus in a first embodiment, FIG. 3 a side view of the device of FIG. 2 with further details, FIG. 4 a side view of a further embodiment of the device, FIG. 5 a top view of the schematically illustrated cross-winding elements of the device of FIG. 4 in the direction V, FIG. 6 a section view of the essential elements of the device in an embodiment, in which the auxiliary apparatus is located in the slit drum, FIG. 7 a side view of the device of FIG. 6, and FIG. 8 a section view of a further embodiment of the device.

FIG. 2 shows a schematic top view of the slit drum of FIG. 1 turned by 90° so that the crossing point 6 of the slit 5 can be seen in the middle of the drawing.

An auxiliary apparatus or crossover guide 10 is allocated to the slit drum 1. The auxiliary apparatus 10 has no traversing function with respect to the traversing of the winding material on the bobbin, but has the purpose to maintain the traversing direction 8 of the winding material while running over the crossing point 6. The auxiliary apparatus 10 here is located outside of the slit drum 1 and thus positioned upstream. A winding material 11 (thread) shown in a dotted line is fed according arrow 12 and runs first to the auxiliary apparatus 10 and then to an always changing entering point 13 of the slit 5, then through a certain portion of the interior of the slit drum 1, and finally leaves the slit drum 1 at an outgoing point 14 always changing with the turns of the slit drum 1.

Figure 3:
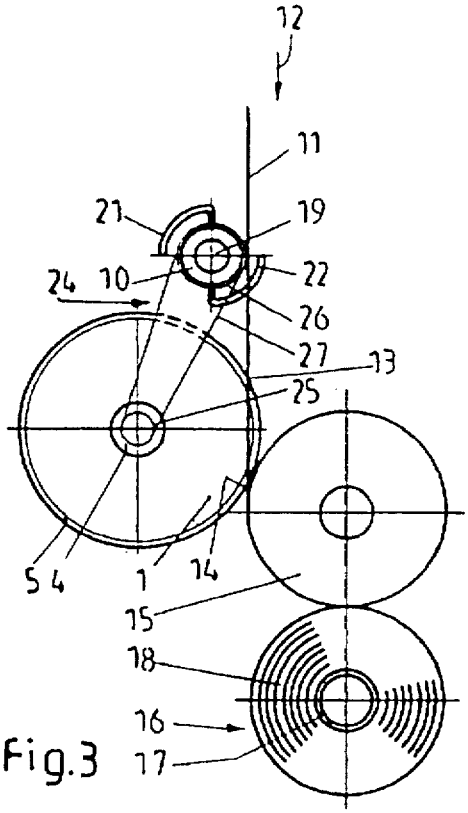

A contact roller 15 is allocated to the outer circumference the slit drum 1 but with a distance to it (FIG. 3). The winding material 11 finally runs to a winding device 16 comprising a not illustrated drive and a tube 17 for taking up winding material 11 on the bobbin 18.

Essential parts of the auxiliary apparatus 10 are illustrated in FIGS. 2 and 3. The auxiliary apparatus 10 comprises a guide shaft 19 carrying a cylindrical sleeve 20. The sleeve 20 provides two transversing elements 21 and 22 on its circumference, which are designed as arms or bows, each arm or bow having a straight segment and a curved segment. The traversing elements 21 and 22 are fixed on the sleeve 20 and are driven in rotation by the shaft 19. The one traversing element 21 is allocated to one transversing direction and the other traversing element 22 is allocated to the other traversing direction. The traversing elements 21 and 22 are located on the sleeve 20 in an angle of 180° to each other with respect to the axis of the shaft 19. Each of the traversing elements 21 and 22 serves to add an additional motion to the winding material while running over the crossing point 6 in fact directed into the corresponding traversing direction 8. This additional motion garantees the run of the winding material over the crossing point without changing the traversing direction. The traversing of the winding material 11 on the bobbin 18 is obtained only by the slit 5, actually within the determined traversing triangle 23 between a fixed point, over which the winding material is fed, and the reversing points 7. The auxiliary apparatus 10 only has the function to pass the crossing point 6 without changing the traversing direction. It touches the winding material 11 at this point in the direction of the desired motion. Since the auxiliary apparatus 10 carries two traversing elements 21 and 22, the shaft 19 has to be driven with half the number of revolutions compared to the shaft 4 of the slit drum 1. Of course this could be achieved by two separate drives only connected to each other by control means. FIG. 3 illustrates a gear 24 consisting of a pinion 25 on the shaft 4 of the slit drum 1, a driven pulley 26 on the shaft 19 of the auxiliary apparatus 10, and a toothed belt 27 connecting the pinion and the driven pulley. The drive of the auxiliary apparatus is derived from the drive of the slit drum 1 and locked to it, so that the radial position of the traversing elements 21 and 22 is allocated with respect to the crossing point 6.

Neither the slit drum 1 nor the auxiliary apparatus 10 provide any parts moving back an forth, so that the oscillating mass is determined only by the portion of the winding material 11 between the fixed point of the traversing triangle and the take up point on the bobbin 18.

Figure 5:
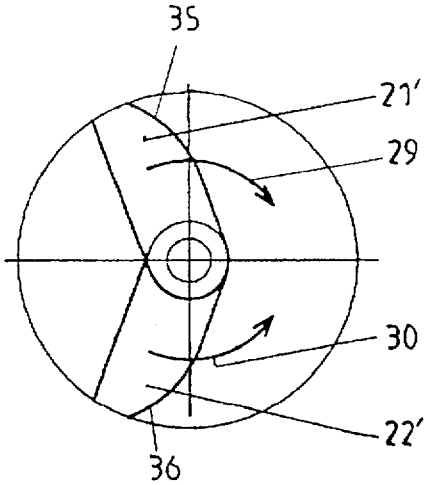
Figure 4:
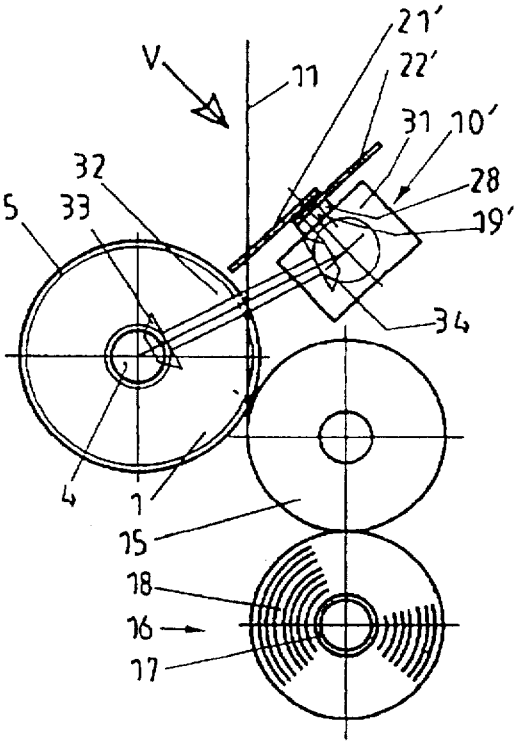

FIGS. 4 and 5 illustrate a further embodiment of the auxiliary apparatus 10' also located outside the slit drum 1. Essential parts of the auxiliary apparatus 10' are two guide shafts 19' and 28 arranged concentrically, with one traversing element 21' connected with the shaft 19' and the other traversing element 22' connected with the shaft 28. The shafts 19' and 28 are driven in directions opposite to each other, so that also the traversing elements 21' and 22' are driven in different directions according to the arrows 29 and 30 (FIG. 5). For this purpose a reverse gear 31 is provided, which is driven via a shaft 32 and two gear wheels 33 and 34. Here also the drive of the auxiliary apparatus 10' is locked to the drive of the shaft 4 of the slit drum 1. The traversing elements 21' and 22' are driven with half the number of revolutions. It can be seen, that the traversing element 21' is allocated to one traversing direction and the other traversing element 22' is allocated to the other traversing direction, so that the crossing point 6 is passed alternatively by the winding material without changing the traversing direction at this point. In the crossing point 6 the rims 35 and 36 shaped correspondingly create a motion to the winding material 11 directed to the left or the right, so that the winding material 11 passes the crossing point 6 in the desired direction.

Figure 6:
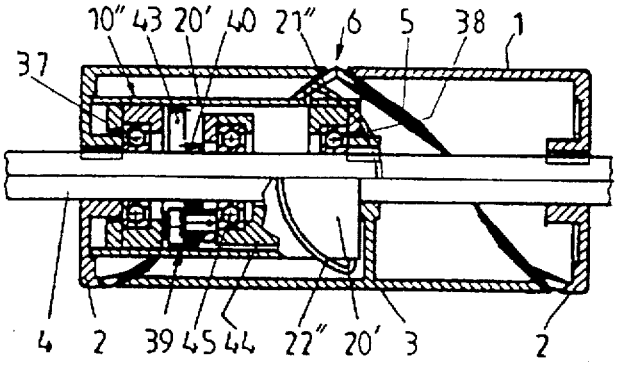
Figure 7:
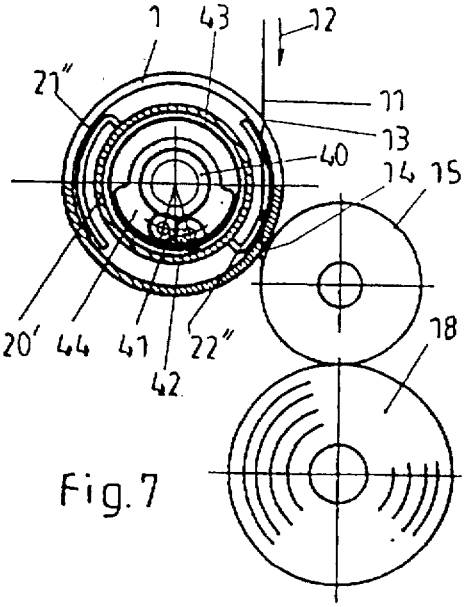

FIGS. 6 and 7 illustrate a further embodiment of the device with the peculiarity that the auxiliary apparatus 10" is positioned in the interior of the slit drum 1. The slit drum 1 here also consists of the two end pieces 2 and the one middle piece 3. The auxiliary apparatus 10" comprises a sleeve 20' designed as an inner drum carrying the traversing elements 21" and 22" its outer circumference with respect to the crossing point 6 of the slit 5. The sleeve 20' is pivotably arranged on the shaft 4 of the slit drum 1 via two ball bearings 37 and 38. A reduction gear 39 is provided between the shaft 4 and the sleeve 20' consisting of a sun wheel 40, two planet wheels 41 and 42, a driving wheel 43, and a weight 44. The sun wheel 40 is fixly arranged on the shaft 4 of the slit drum 1 and thus is driven in rotation corresponding to the revolutions of the shaft 4. The weight 44 is pivotably arranged on the shaft 4 via a ball bearing 45. The weight 44 stands still and is never rotated. It hangs on the rotating shaft 4 and forms the location of the axes of the two planet wheels 41 and 42. The planet gear 41 meshes with the sun gear 40, while on the other hand the planet wheel 42 meshes with the planet wheel 41 for reversing the direction of revolutions. The planet wheel 42 finally drives the driven wheel 43, which is fixly arranged on the sleeve 20' of the auxiliary apparatus. The transmission to half of the number of revolutions is obtained by according geometrical design. The sleeve 20' with the two traversing elements 21 and 22" is driven with half the number of revolutions compared with the number of revolutions of the shaft 4. The rotating direction of the shaft 4 and thus of the circumference of the slit drum 1 is equal to the rotationg direction of the sleeve 20' of the auxiliary apparatus 10", in fact in the direction determined by the arrow 12 of the winding material 11.

Figure 8:
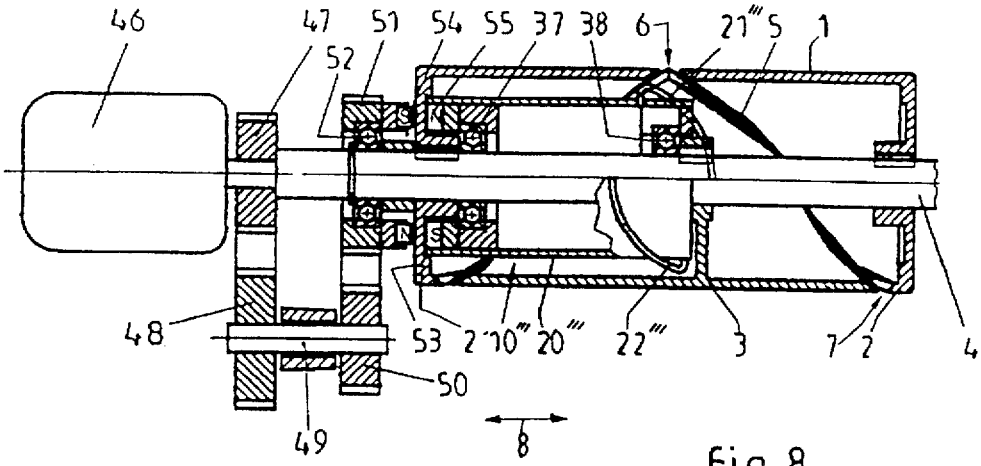

A further embodiment of the device is illustrated in FIG. 8. Essential parts of the auxiliary apparatus 10'" here also are located in the interior of the slit drum 1, i.e. the sleeve 20" and the two traversing elements 21'" and 22'". The sleeve 20" is pivotably arranged on the shaft 4 of the slit drum 1 via the two ball bearings 37 axed 38. The shaft 4 is driven by an electrical motor 46, the axis of which is in alignment with the axis of the shaft 4. The drive for the auxiliary apparatus 10'" and the elements needed for it are located outside the slit drum 1.

Thus, a driving pulley 47 in the form of a gear wheel or a belt pulley is fixly arranged on the shaft 4. The drive is transmitted to a driving pulley 48 arranged on the shaft 49. A driving pulley 50 is positioned on the shaft 49, meshing with a driving pulley 51 arranged pivotably on the shaft 4 via a ball bearing 52. The design of the driving pulleys 47 to 51 is choosen in that way that the needed reduction in the number of revolutions of the auxiliary apparatus '" compared with the number of revolutions of the slit drum 1 is generated. In this case two traversing elements 21'" and 22'" are provided for the crossing point 6, so that the sleeve 20" of the auxiliary apparatus is driven with half the numbers of revolutions compared with the number of revolutions of the shaft 4 of the slit drum 1. The transmission of the drive of the driving pulley 51 to the sleeve 20" through the wall 53 is performed by the aid of a permanentmagnetic clutch, part one 54 of which is connected with the driving pulley 51 and the other part 55 of which is connected with the sleeve 20" of the auxiliary apparatus 10'".

| | |
|---|---|
| 1 - slitt drum | 31 - reverse gear |
| 2 - end piece | 32 - shaft |
| 3 - middle piece | 33 - gear wheel |
| 4 - shaft | 34 - gear wheel |
| 5 - slit | 35 - rim |
| 6 - crossing point | 36 - rim |
| 7 - reversing point | 37 - ball bearing |
| 8 - traversing direction | 38 - ball bearing |
| 9 - traversing width | 39 - reduction gear |
| 10 - auxiliary apparatus | 40 - sun wheel |
| 11 - winding material | 41 - planet wheel |
| 12 - arrow | 42 - planet wheel |
| 13 - entering point | 43 - driven wheel |
| 14 - outgoing point | 44 - weight |
| 15 - contact roller | 45 - ball bearing |
| 16 - winding device | 46 - electrical motor |
| 17 - tube | 47 - driving pulley |
| 18 - bobbin | 48 - driving pulley |
| 19 - shaft | 49 - shaft |
| 20 - sleeve | 50 - driving pulley |
| 21 - cross-winding element | 51 - driving pulley |
| 22 - cross-winding element | 52 - ball bearing |
| 23 - traversing triangle | 53 - wall |
| 24 - gear | 54 - part |
| 25 - pinion | 55 - part |
| 26 - driven pulley | |
| 27 - toothed belt | |
| 28 - shaft | |
| 29 - arrow | |
| 30 - arrow | |

I claim:

1. Winding apparatus for cross-winding a winding material on a bobbin, the winding apparatus comprising:

a winding drum composed of first and second end pieces and a central piece positioned between said end pieces, said end pieces and said central piece each having a thin outer wall which forms the periphery of said winding drum, said walls being arranged to form a bottomless continuous helical slit along the periphery of said winding drum, said continuous helical slit providing access to the interior of said winding drum and configured in the shape of a figure eight which extends along a longitudinal extent of said winding drum periphery such that said continuous helical slit crosses itself at a crossing point on said winding drum;

a drum shaft, said end pieces and said central piece being fixedly mounted to said drum shaft such that said winding drum can rotate with said drum shaft; and a crossover guide positioned adjacent said winding drum periphery, said crossover guide having a guide shaft and a cylindrical sleeve mounted on said guide shaft opposite said central piece of said winding drum, said crossover guide further including at least one bow mounted on said cylindrical sleeve for urging the winding material along said continuous helical slit at said crossing point;

wherein the winding material is fed through said continuous helical slit to the bobbin as said winding drum and said crossover guide rotate on said drum shaft and said guide shaft respectively, said crossover guide maintaining the direction of travel of the winding material along the continuous helical slit at said crossing point.

2. The winding apparatus of claim 1, wherein said crossover guide includes two bows mounted on opposite sides of said cylindrical sleeve.

3. The winding apparatus of claim 2, wherein each bow has a straight segment extending radially outwardly from said cylindrical sleeve and a curved segment extending from said straight segment.

4. The winding apparatus of claim 2 further comprising means for driving said drum shaft and said guide shaft, wherein said guide shaft completes a number of revolutions which is an even factor of the number revolutions completed by said drum shaft during a predetermined interval of time.

5. The winding apparatus of claim 4, wherein the means for driving said drum shaft and said guide shaft includes a reduction gear system.

6. The winding apparatus of claim 4, wherein the means for driving said drum shaft and said guide shaft includes a belt and pulley system.

7. The winding apparatus of claim 1, wherein the crossover guide is positioned outside of the winding drum.

8. The winding apparatus of claim 7, wherein said crossover guide includes two bows mounted on opposite sides of said cylindrical sleeve.

9. The winding apparatus of claim 1, wherein the crossover guide is mounted inside the winding drum.

10. The winding apparatus of claim 9, wherein said crossover guide includes two bows mounted on opposite sides of said cylindrical sleeve.

11. Winding apparatus for cross-winding a winding material on a bobbin, the winding apparatus comprising:

a winding drum composed of first and second end pieces and a central piece positioned between said end pieces, said end pieces and said central piece each having a thin outer wall which forms the periphery of said winding drum, said walls being arranged to form a bottomless continuous helical slit along the periphery of said winding drum, said continuous helical slit providing access to the interior of said winding drum and configured in the shape of a figure eight which extends along a longitudinal extent of said winding drum periphery such that said continuous helical slit crosses itself at a crossing point on said winding drum;

a drum shaft, said end pieces and said central piece being fixed mounted to said drum shaft such that said winding drum can rotate with said drum shaft; and a crossover guide positioned adjacent said winding drum periphery, said crossover guide having a first guide shaft and a second guide shaft configured concentrically with one another, said crossover guide further including a first traversing element mounted on said first guide shaft and a second traversing element mounted on said second guide shaft;

wherein the winding material is fed through said continuous helical slit to the bobbin as said winding drum and said traversing elements rotate with their respective shafts, said first traversing element and said second traversing element rotating in opposite directions such that the crossover guide maintains the direction of travel of the winding material along the continuous helical slit at said crossing point with said traversing elements alternately guiding the winding material through said crossing point.

12. The winding apparatus of claim 11 further comprising means for driving said drum shaft and said guide shafts, and wherein said crossover guide further includes a reversing gear connected to said first guide shaft, said second guide shaft, and said means for driving, said reversing gear providing for the opposed rotation of said traversing elements.

13. The winding apparatus of claim 12 wherein said means for driving includes a connecting shaft having a gear wheel mounted at each of its ends, said connecting shaft connecting said drum shaft and said guide shafts.

14. A method for cross-winding a winding material on a bobbin, the method comprising the steps of:

providing a winding drum having a bottomless continuous helical slit provided therethrough, the slit crossing itself on a periphery of the winding drum at a crossing point;

providing a crossover guide in operative relationship with said winding drum, said crossover guide having a cylindrical sleeve mounted thereon, the sleeve having first and second bows;

rotating the winding drum and the crossover guide in a timed relationship with each other;

feeding the winding material from a fixed point remote from the winding drum to the bobbin with the winding material first traveling along the continuous helical slit and through the winding drum as the winding drum is rotated about its longitudinal axis; and alternately guiding the winding material through the crossing point of the continuous helical slit with the first and second bows of the crossover guide such that the winding material will traverse the crossing point without changing directions along the continuous helical slit, the winding material contacting the bows only when crossing the crossing point.

15. A method for cross-winding a winding material on a bobbin, the method comprising the steps of:

providing a winding drum having a bottomless continuous helical slit provided therethrough, the slit crossing itself on a periphery of the winding drum at a crossing point;

providing a crossover guide in operative relationship with said winding drum, said crossover guide having first and second concentric guide shafts and first and second traversing elements mounted to the first and second concentric guide shafts respectively;

rotating the winding drum and the crossover guide in a timed relationship with each other with said first and second traversing elements rotating in opposite directions on the first and second guide shafts respectively;

feeding the winding material from a fixed point remote from the winding drum to the bobbin with the winding material first traveling along the continuous helical slit and through the winding drum as the winding drum is rotated about its longitudinal axis; and alternately guiding the winding material through the crossing point of the continuous helical slit with the first and second traversing elements such that the winding material will traverse the crossing point without changing directions along the continuous helical slit, the winding material contacting the traversing elements only when crossing the crossing point.

* * * * *